United States Patent [19]

Frenkel et al.

[11] 3,968,965

[45] July 13, 1976

[54] GAME RACKET

[76] Inventors: Richard E. Frenkel, 17 Kingston Road, Scarsdale, N.Y. 10583; Allan E. Schwartz, 3 Bristol Place, Yonkers, N.Y. 10710

[22] Filed: Jan. 22, 1974

[21] Appl. No.: 435,484

Related U.S. Application Data

[63] Continuation-in-part of Ser. No. 341,156, March 14, 1973, Pat. No. 3,833,218.

[52] U.S. Cl. ..... 273/73 J; 273/75; 74/56; 85/67; 85/79

[51] Int. Cl.[2] ..... A63B 49/08

[58] Field of Search ..... 273/73 R, 73 C, 73 H, 273/73 J, 73 E, 73 G, 75, 81 R; 145/61 R; 74/55–58, 63; 85/63, 67, 73–79, 82, 83; 403/343, 350, 358

[56] References Cited

UNITED STATES PATENTS

| | | | |
|---|---|---|---|
| 1,020,018 | 3/1912 | Bonin | 273/73 C UX |
| 1,548,134 | 8/1925 | Gallaudet | 273/73 C |
| 1,684,449 | 9/1928 | Kleinman | 273/73 E |
| 2,097,616 | 11/1937 | Davis | 273/73 J |
| 2,395,864 | 3/1946 | Gerrlings et al. | 273/73 J |
| 2,460,685 | 2/1949 | Ford | 145/61 R X |
| 2,576,751 | 11/1951 | Dortmund | 273/73 J UX |
| 3,022,700 | 2/1962 | Dempsey | 85/76 |
| 3,301,123 | 1/1967 | Worley | 85/79 |
| 3,303,736 | 2/1967 | Raynovich | 85/67 |
| 3,472,111 | 10/1969 | Ono | 85/79 X |
| 3,501,148 | 3/1970 | Cheris et al. | 273/75 |
| 3,540,728 | 11/1970 | Palmer | 273/73 J |
| 3,638,943 | 2/1972 | Snauwaert | 273/73 J |
| 3,833,219 | 9/1974 | Dean | 273/73 J X |
| 3,884,099 | 5/1975 | Sikstrom | 85/75 |

FOREIGN PATENTS OR APPLICATIONS

| | | | |
|---|---|---|---|
| 15,053 | 7/1902 | United Kingdom | 273/73 E |
| 325,427 | 2/1930 | United Kingdom | 273/73 C |
| 710,625 | 6/1954 | United Kingdom | 273/73 J |
| 808,614 | 2/1959 | United Kingdom | 145/61 R |

*Primary Examiner*—Richard J. Apley
*Attorney, Agent, or Firm*—Arthur Dresner

[57] ABSTRACT

A racket for use in games such as tennis, badminton, squash paddle ball, etc. having a head and a handle which may be detachably connected to said head at a throat. The head comprises a frame defining a stringing or ball contact area and a throat connected with the frame. The handle has an axially extending rotatable member, such as a threaded bolt. The bolt may extend beyond the handle for attachment to the head. An internally threaded insert is carried by said throat for receiving the bolt so that the handle may be secured to and detached from the head. Guide pins are provided on the handle for engagement with the throat so that the handle will be properly aligned with the head. Grip expanding structure is carried within a partially hollow handle so as to vary the diameter of the handle. The expanding structure includes radially movable wall plates and a rotatable element such as a rod axially carried within the handle. An expander assembly is carried on the rotatable member for applying pressure to the wall plates upon rotation of the rotatable member so as to vary the diameter of the handle.

7 Claims, 13 Drawing Figures

FIG.5
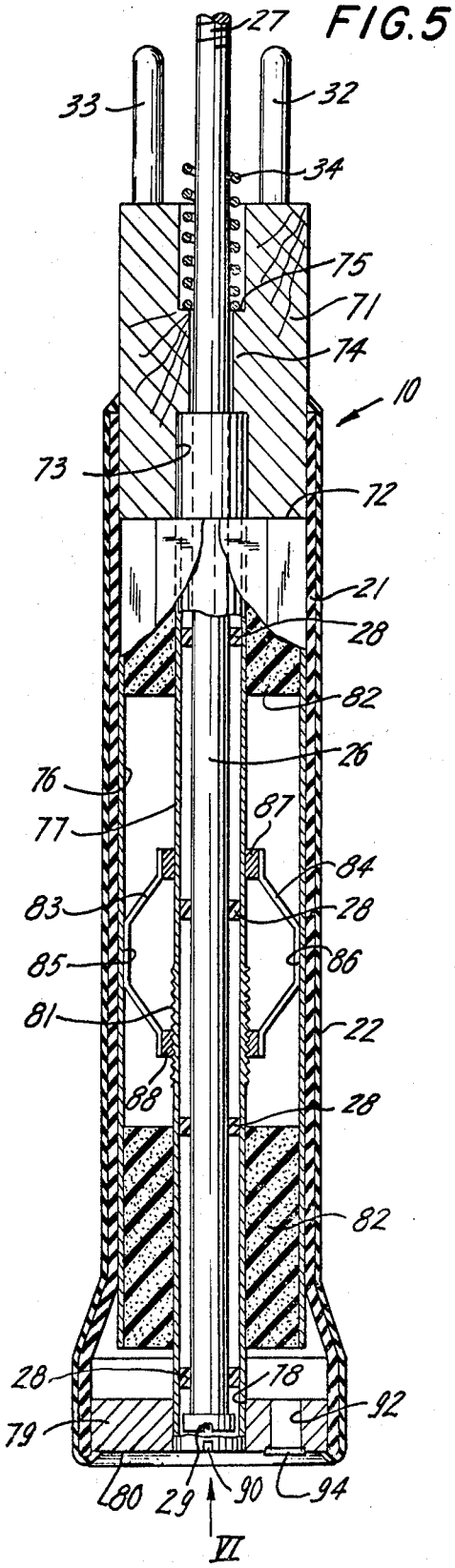
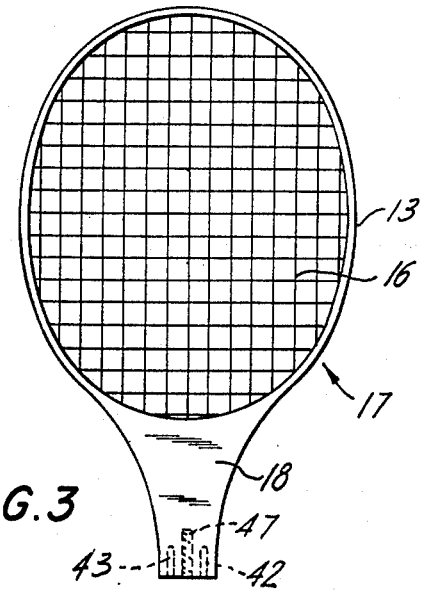
FIG.3
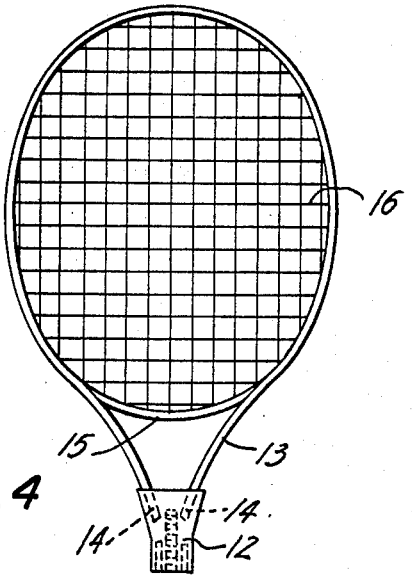
FIG.4
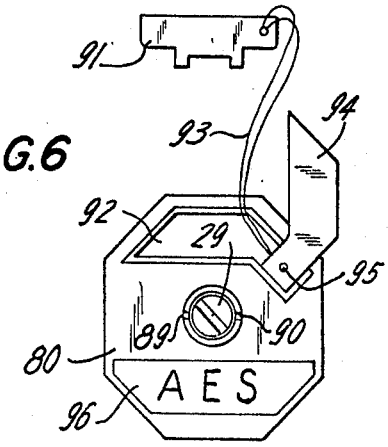
FIG.6

FIG. 10
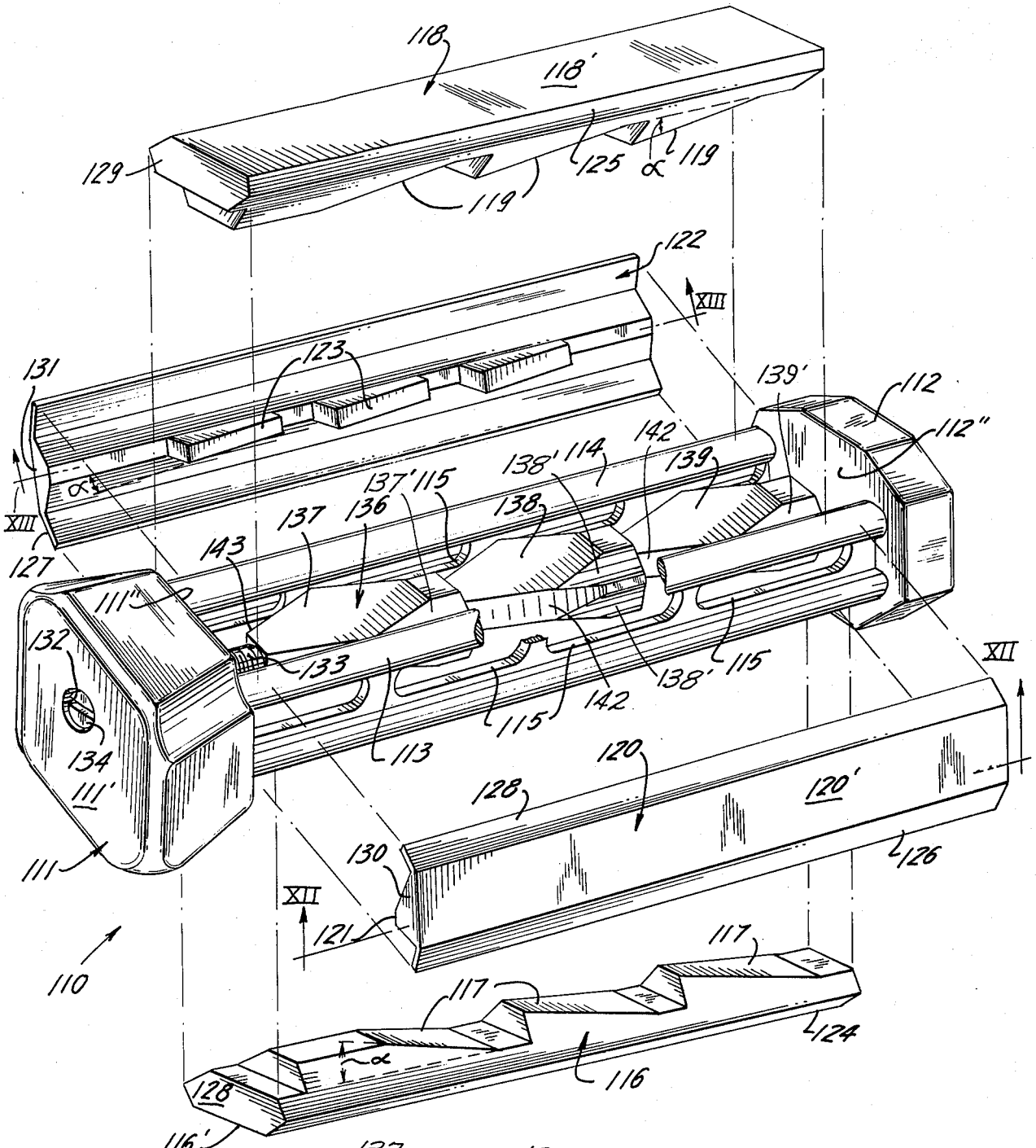
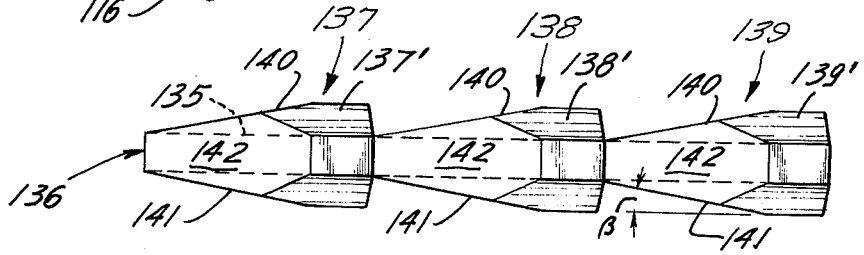
FIG. 11

FIG. 12
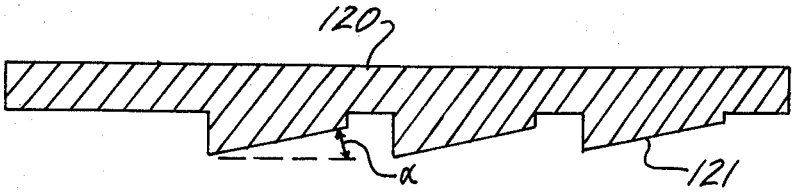
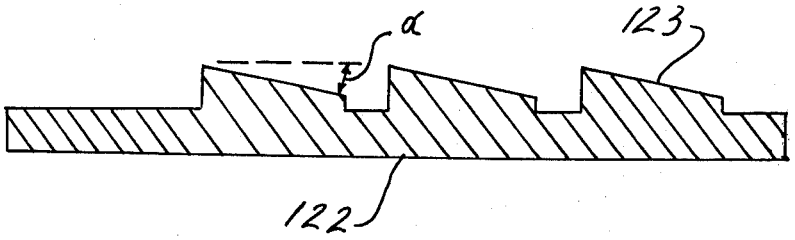
FIG. 13

GAME RACKET

CROSS REFERENCE

This is a continuation-in-part of co-pending application Ser. No. 341,156 filed Mar. 14, 1973, and now U.S. Pat. No. 3,833,218.

BACKGROUND OF THE INVENTION

The present invention relates generally to a racket for use in playing such games as tennis, badminton, squash, paddle ball and other such similar games employing the use of a racket which is generally constructed having a frame or head portion connected at a neck or throat to a handle or grip portion. Specifically, the present invention is directed to such a racket in which the handle has an expandable grip and which may be detachably connected to the frame or head so that the racket may be rendered hybrid.

Over the years rackets for use in such games specifically in the game of tennis have been made of a variety of materials so as to provide certain advantages in playing the game. The widely used and well-known wooden racket is typically formed with the head and handle portion integral. The handle is formed of a shank extending from the head. The actual grip of the handle or grip portion is usually a thickened section of the shank having a hand-gripping cover such as leather or rubber wrapped about the thickened handle. The wooden racket presents several disadvantages to the user. These include possible warping of the frame and breaking the racket at the neck area or about the frame.

In order to overcome the disadvantages of the wooden racket the modern day metal racket was developed. These rackets are typically made of aluminum, aluminum alloys, steel, etc., and provide the required durability and tend to be lighter in weight than the wooden racket. The new metal rackets have met with significant commercial success — however these, like the wooden rackets, are typically constructed with the head and handle portions being integrally formed from a frame having an extended shank. The actual grip of the handle may be formed by a built-up area on the shank to form a thickened portion similar to the thickened portion of the well-known wooden racket.

In any case, whether the racket be made of wood or whether it be made of a metal, metal alloy, or any other material, the grip portion is formed integrally with the entire racket. Should a player decide to alter the type of grip which he chooses to use of to change the size of the grip or its weight, he would be required to obtain an entirely new racket at considerable expense, rather than simply a new grip. Further, in marketing the typical integral tennis racket an enormous stock of rackets, having different size grips, type of grips, lengths, etc. has to be maintained by the sporting goods supplier so that the purchaser may have his choice of grip.

Many people prefer the wooden frame racket, or may wish to play with a wooden racket only temporarily. They are required to purchase an entirely new racket. The change to a wooden racket also requires that the player become accustomed to a new grip which is an integral part of the new racket.

The player may purchase a new racket for a variety of reasons. Tennis rackets are provided with strings carried by the frame or head portion which are usually either gut or nylon. Both of these materials provide certain advantages under different playing conditions and a player for one reason or other may decide to play with nylon under one set of conditions while choosing to play with the gut stringing under another set of conditions. In order to satisfy this particular player's needs he would have to be supplied with two entirely separate tennis rackets, each having the different stringing material. Again this is a situation which requires the player to become accustomed to using a different grip with each tennis racket. A tennis player may also choose to purchase a new racket simply because the head portion of his racket has become seriously damaged and requires replacement. Again, a new tennis racket with a new grip will be required.

The size, weight distribution, "feel" and overall adaptability to a player's peculiar hand of a particular grip becomes a factor upon which a player becomes accustomed and relies on. Any change or alteration in these factors tends to require a period of adjustment. It is therefore most desirable if a player can rely on the security of a particular grip and the knowledge that he can use "his" grip no matter what type of head he chooses to use.

For these reasons, tennis rackets having a detachable grip or handle portion, in order to provide an interchangeability feature have been proposed so that a single grip can be used with a variety of head or frame portions. This would allow a merchant to stock a wide variety of grips to meet the various size and weight needs while only one or two basic frames which may be used with the grip need be stocked. Most recent examples of such tennis rackets are shown in U.S. Pat. Nos. 3,547,440 and 3,638,943. The prior attempts at tennis rackets have interchangeable grips however, does not appear to have met with any appreciable commercial success. Probable reasons for such failure appears to be the fact the the interchangeability feature is specifically limited to changing the type of grip which is used on a particular tennis racket rather than changing the type of head or frame portion which may be used with a particular grip. In the prior devices the frame or head portion is still made integral with an extended shank portion even though the actual grip which may be attached to the shank is interchangeable with other size grips. The merchant is still required to stock a large supply of handle or grip portions. This approach overlooked the desirability of providing a variety of head portions made of various materials such as the well-known wood or metal rackets so as to be interchangeable with the particular grip. Further, various head portions being strung with different materials, whether it be gut, nylon, or metal, can also be provided for use with a particular grip. Also, if a player should require or desire to play with a grip having a different size he would have to turn to an entirely new grip or handle having the required size. Further versatility is provided by the present invention by providing an expanding grip mechanism in the handle so that various sizes are available for use with the different head which is chosen.

Accordingly, it is a general object of the present invention to provide a racket for use in playing such games as tennis, badminton, squash, paddle ball, etc. in which the grip or handle portion is detachable from the frame or head portion at the throat or neck area of the racket thus providing an interchangeability feature.

Another object of the invention is to provide such a racket so that handles having different lengths may be used with the same head for use by children, adolescents or adults.

It is a further object of the present invention to provide a tennis racket of the aforementioned type in which a hybrid tennis racket having a head portion made of one type of material may be combined with a grip or handle portion made of a different type of material so as to provide the various advantages of each.

It is still a further object of the present invention to provide a racket having a detachable handle in which the means for attaching the handle to the head portion provides rigidity and firmness of structure between the handle and frame and proper alignment between these elements.

A still further object of the present invention is to provide such a tennis racket in which the throat portion of the racket provides an interface and connecting element between the head and handle portions.

A further object is to include an extended screw element running the length of the grip or handle for providing a means of secure attachment between the handle and the head portion.

Another object of the invention is to provide a tennis racket which has means for varying the size of the actual grip so that a player may continue using the same grip but altering its size to suit his or another's need.

Other objects, advantages and features of the invention will become more apparent from the following detailed description of the invention in connection with the accompanying drawings in which:

BRIEF DESCRIPTION OF THE DRAWINGS

FIG. 3 is a plan view of one type of tennis frame which may be used with the detachable handle shown in FIG. 1;

FIG. 4 is a plan view of another type of tennis frame and throat which may be used with the detachable handle shown in FIG. 1 or FIG. 2;

FIG. 5 is an elevational view partly broken away and sectioned showing one type of expanding grip mechanism;

FIG. 6 is a bottom view of the handle shown in FIG. 5 as viewed in the direction of arrow VI;

FIG. 10 is an exploded perspective view showing another type of expanding grip mechanism;

FIG. 11 is a side elevational view of a cam member used in the mechanism shown in FIG. 10;

FIG. 12 is a sectional view taken along lines XII—XII of FIG. 10; and

FIG. 13 is a sectional view taken along lines XIII—XIII of FIG. 10.

DESCRIPTION OF THE INVENTION

Figure 1:
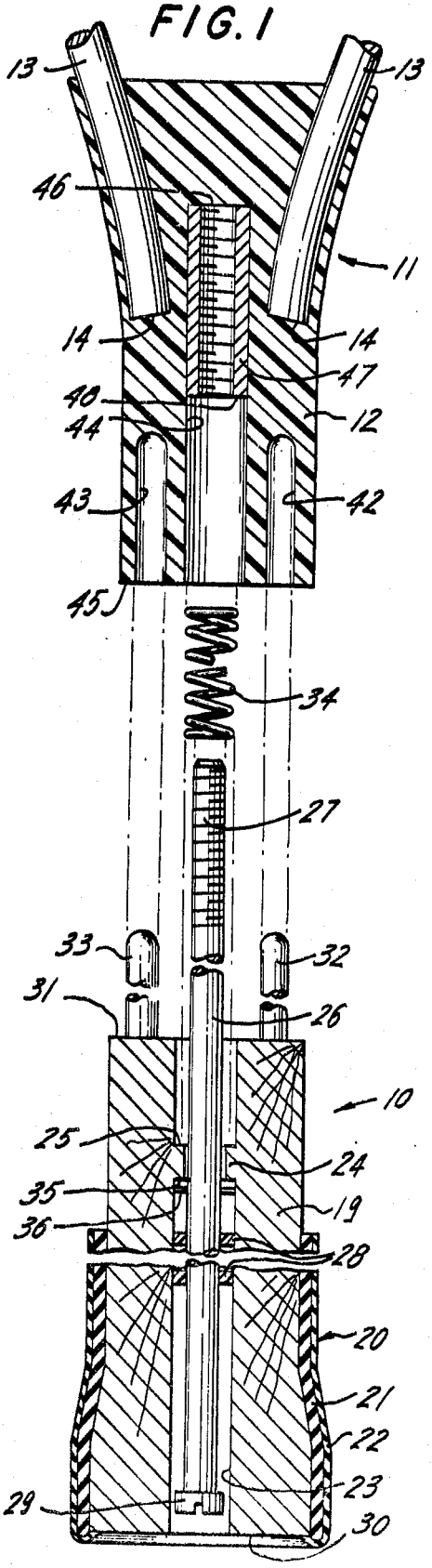
FIG. 1 is an exploded and sectioned elevational view of one embodiment of the present invention.

Referring now more in detail to the accompanying drawings, FIG. 1 shows in an exploded view one embodiment of a hybrid tennis racket as envisioned by the present invention. The combination racket includes basically two components, to wit a handle portion 10 and a head portion 11. The head 11, an example of which is shown in FIG. 4 is formed of a throat 12 and a frame 13. The frame 13 may be made of aluminum, steel, chrome, or other lightweight metal circularly or elliptically shaped terminating in the throat 12 at ends 14, and having a bridge element 15 so as to complete the uniform shape of the head which generally defines a stringing area. The strings 16 are supported by the frame in any of a variety of well-known manners, none of which form part of the present invention. The strings 16 may be either the well-known nylon, gut or metal.

The frame 13 may further be constructed of plastic, fiberglass, wood or any other material which is found suitable for meeting the durability and response requirements of playing the game in which the racket is to be used. The throat portion 12, which may be either formed integrally with the frame as shown in FIG. 3, or separately secured to the frame 13 as shown in FIG. 4 may likewise be made of any suitable material. It is suggested however, that one most suitable combination is to form the throat 12 of a molded plastic in which the frame 13, preferably made of metal tubing is secured to the throat during the molding process. FIG. 1 shows the throat 12 as being plastic, fiberglass or other synthetic material with the frame 13 embedded within the molded throat. The head shown in FIGS. 1 and 4 therefore provides the player with all of the advantages of the successful metal racket in which the frame 13 is formed of suitable metal tubing. When a player decides to use such a metal racket this type of head is available. FIG. 3, on the other hand, shows a head portion 17 formed completely of wood having a wooden frame 13 and an intergrally formed wooden throat 18.

Either of the head portions, such as shown in FIGS. 3 and 4, may be used with the separate handle 10 such as shown in FIG. 1. The handle may also be made of a variety of metals. The handle shown in FIG. 1 is shown to be made of wood so as to provide the damping advantages inherent in this material. The handle 10 generally comprises the handle body 19 and a grip area 20. As previously noted, the body shown in FIG. 1 is made of wood. A conventional leather, plastic or rubber grip 21 is wound about the grip area of the body and may be covered with a reusable and disposable plastic or polyethelene covering 22 so as to protect the actual grip material.

In FIG. 1, the handle body 19 has an axially extending central bore 23 extending the entire length of the handle body. A necked-down portion 24 forming shoulders 25 and 35 is located in the upper part of the bore 23. A bolt 26 having a partially threaded portion 27 is carried within the bore 23 and may be journalled between bearings 28 which are preferably Teflon O-rings having a square cross-sectional area. The end of the bolt 26 which is remote from the threaded portion 27 has a slotted head 29 which is located near the base 30 of the handle body. The head 29 is slightly recessed into the bore 23 so as not to protrude beyond the base of the handle. A flange (or pin) 36 is carried on the bolt for locating the bolt within the bore preventing axial movement in a direction away from the head of the bolt by engagement with shoulder 35. End face 31 of the handle body is provided with a pair of guide pins 32 and 33. One of the guide pins 32 may have a somewhat smaller diameter than the other guide pin 33 for proper alignment into the throat portion 12 of the head 11. A tension spring 34 is helically wound about the bolt 26 and bears at one end thereof against a shoulder 25 formed by necked-down area 24. The guide pins 32 and 33 may be conveniently secured to the handle body preferably by screwing in place.

The throat 12 of the head portion is provided with a pair of guide slots 42 and 43 so as to receive the guide pins 32 and 33 of the handle. Guide slot 42 has a diameter slightly less than guide slot 43 so as to accommodate guide pin 32 and guide slot 43 having a diameter for receiving guide pin 33. In this manner the head and handle portions can be secured to one another with proper and consistent alignment so that the opposite faces of the head will always be aligned with corresponding parts of the handle.

A partial bore 44 extends from the base 45 of the throat terminating at 46 located approximately two-thirds of the depth of the throat. The bore 44 is axially and centrally located and is aligned with bore 23 of the handle when the handle is secured to the throat. An internally threaded metal insert 47 is secured at the end of the partial bore 44 for receiving the threaded end 27 of bolt 26. The insert 47 may be secured in place within the partial bore as by wedging or during the molding process of the throat. Partial bore 44 and guide slots 42, 43 may either be formed during molding or by a machining operation subsequent to molding.

Figure 7:
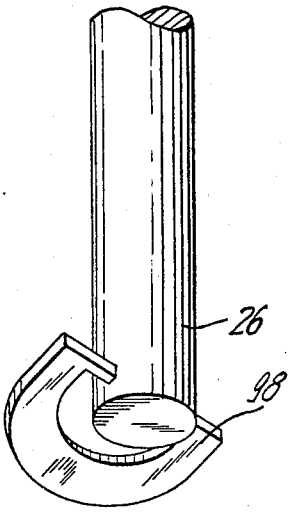
FIGS. 7 and 8 are perspective view of alternative features of the invention.
Figure 8:
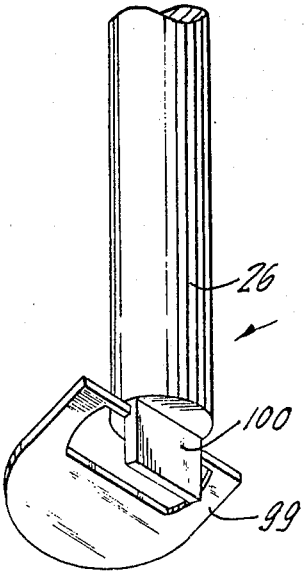

In operation, in order to secure the handle 10 to the head 11, bolt 26 is inserted into partial bore 44 of the throat, guide pins 32 and 33 being aligned so as to be inserted into guide slots 42 and 43 respectively. Threaded portion 27 is then screwed into insert 47 by turning the bolt 26 by means of a tool applied to the slotted end 29 at the base of the handle. Alternative means for causing rotation of the bolt may be carried by the bolt itself. FIG. 7 shows such a means as comprising bolt removal key 98 pivotally carried at the end of bolt 26. When not in use the key may be recessed within bore 23. The end of the bolt 26 may also have a tab area 100 as shown in FIG. 8 so as to carry a key 99 of the type shown in FIG. 8.

The other end of spring 34 bears against end 48 of insert 47 so as to provide proper tension between the throat and the handle and so as to urge the handle 10 away from the throat 12 thereby facilitating the disassembling operation, and together with the pins and slots, to provide proper rigidity and firmness of structure. Disassembly is accomplished by unscrewing the bolt from the insert 47 by means of applying the same tool to the slotted end 29 of the bolt. The bolt 26 is screwed into the insert 47 until base 45 of throat 12 and end face 31 interface in a smooth transition. The bolt 26 and guide pins 32 and 33 are sufficiently long so as to provide adequate stability between the head and handle body. The exact length of these elements and the degree of depth of insertion is determined by the relative size of the throat portion and may vary between one and three inches.

A truly hybrid tennis racket is formed by attaching the handle 10 as shown in FIG. 1 to the head 11. The handle 10 being made of wood provides all the advantages of a wooden racket while all the advantages of a metal frame as provided by the head 11 are combined with it. Any number of other combinations of hybrid tennis rackets are also obtainable in this manner. For example, the wooden handle 10 may be combined with a totally wooden frame 17 such as shown in FIG. 3. The throat area 18 of the wooden frame 17 will similarly have a metal insert 47 located in the partial bore 44 for receiving the threaded end 27 of bolt 26, guide slots 42 and 43 provided in the throat 18 of the wooden frame for receiving the guide pins 32, 33.

Figure 2:
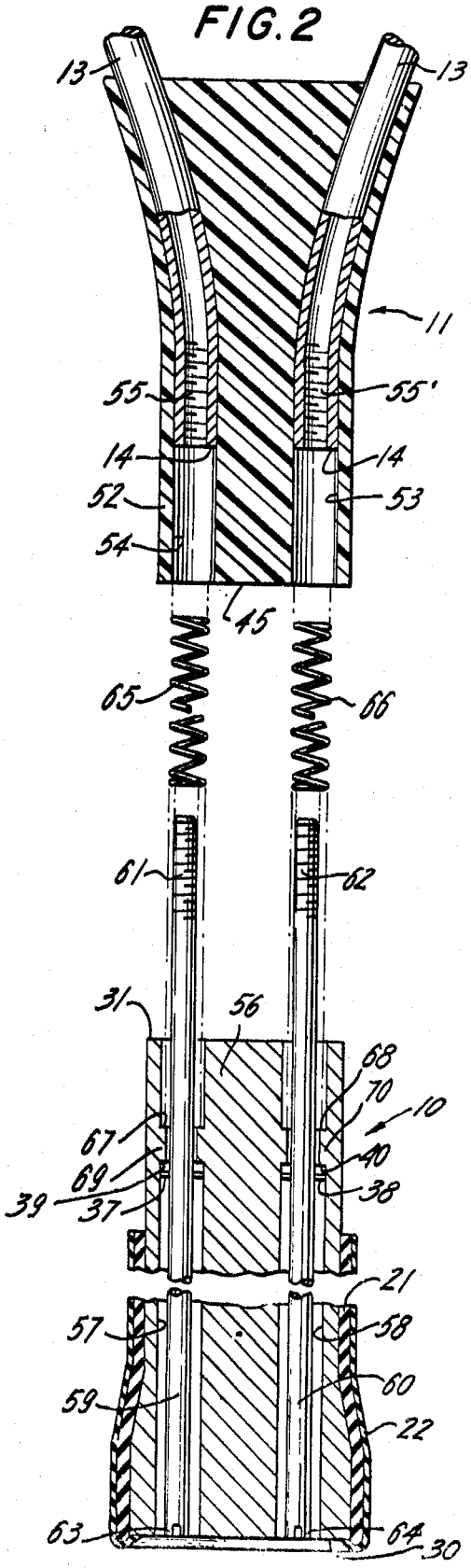
FIG. 2 is also an exploded and sectioned elevational view showing another embodiment of the present invention.

A further embodiment of the hybrid tennis racket is shown in FIG. 2. In this embodiment, the throat portion 52 has two guide slots 53 and 54 which are aligned with the ends 14 of the metal tubular frame 13 of the head 11. The ends 14 of frame 13 are internally threaded at 55 and 55' as shown in FIG. 2. Alternatively internal threaded metal inserts 55 may be carried at the ends 14 of the tubular frame 13. The metal inserts may be secured in place by press fitting or by set screws which may be provided on an outside surface of the tubular frame 13 at the ends 14 and secured so as to secure the metal inserts in place prior to molding the throat 52 with the ends of the frame embedded in the throat.

The handle 10 for use with the head 11 shown in FIG. 2 comprises a handle body 56 which may be made of wood, as is shown in FIG. 1, or may be made of metal such as cast aluminum or magnesium as shown in FIG. 2. Axial bores 57 and 58 are provided in the handle body 56 and accommodate bolts 59 and 60 respectively. Bolts 59 and 60 have partially threaded ends 61 and 62 respectively arranged for engagement with internally threaded inserts 55 and 55' carried by the tubular metal frame 13. Bolts 59 and 60 have slotted ends 63 and 64 respectively at the base 30 of the handle which may be either slightly recessed at the base or arranged flush therewith as shown in FIG. 2. The key and bolt arrangements shown in FIGS. 7 or 8 may be used with bolts 59 and 60 instead of slots 63 and 64 respectively. Springs 65 and 66 are carried by the ends of the bolts 59 and 60 respectively and act at one end thereof against shoulders 67 and 68 respectively provided by necked-down area 69 and 70 within bores 57 and 58 respectively. Bolts 59 and 60 carry flanges 37 and 38 respectively which engage shoulders 39 and 40 respectively of necked-down areas 69 and 70 respectively to prevent axial removal of the bolts when the handle is secured to the head.

During assembly the threaded ends of bolts 59 and 60 are inserted into guide slots 54 and 53 and secured in metal inserts 55 of the tubular frame 13 by turning the bolts 59 and 60 at the slotted ends 63 and 64 or by keys 98 or 99. In this manner a secure connection of the handle to the head is accomplished by direct securement of the bolts through the handle to the frame 13. The bolts are screwed into the inserts until base 45 of the throat 52 and end face 31 of the handle body 56 interface in a smooth transition.

A further advantageous feature of the present invention is to provide the handle 10 with an adjustable grip so that a single grip can be used for different players who are accustomed to different sized grips or may be used by the same player who wishes to vary the size of his grip. In FIG. 5 there is shown a handle 10 of the type shown in FIG. 1 having a body portion 71 which is solid up to body base 72 and is provided with an axial central bore 73 which has a necked-down portion 74 forming a shoulder 75 against which spring 34 bears. The remainder of the handle 10 extending from the base of body 71 to the base of the handle 80 is substantially hollow enclosed by movable wall plates 76 which may either form a cylinder so that the handle has a circular cross-section or may be formed into the familiar octagonal cross-section of the typical tennis racket handle. A hollow metal sleeve 77 is centrally and axially arranged through the handle 10 accommodated within the bore 73 of body 71 and in a bore 78 of base insert 79. The sleeve 77 has an externally threaded portion 81. The bolt 26 having a partially threaded end section 27 is carried within the sleeve 77 journalled between the teflon O-ring bearings 28 as described with reference to FIG. 1. In the embodiment shown in FIG. 5 there are four such O-rings rather than two as shown in FIG. 1. In order to provide rigidity and further substance to the hollow handle portion, foam or sponge rubber packing 82 is provided. An expander assembly is carried on the threaded portion of the sleeve 77 for varying the external diameter of the grip. The assembly comprises at least two flex elements 83 and 84 secured such as by riveting or spot welding at 85 and 86 respectively to the wall plates 76. The flex elements are preferably made of spring steel and are connected at one end to a slide ring 87 arranged for sliding movement over the sleeve 77, and at their other end to an internally threaded ring 88 which is in engagement with the external threads 81 carried by sleeve 77.

Figure 9:
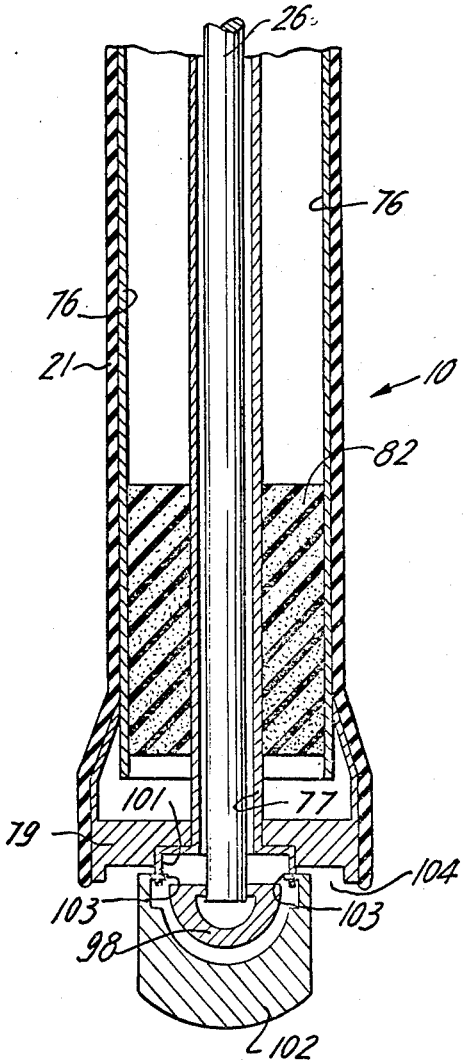
FIG. 9 is a sectioned elevational view showing an alternative to one of the features shown in FIG. 5.

The sleeve 77 is provided with means for causing rotation thereof. One such means is shown in FIG. 5 with the sleeve having diametrically opposed slots 89 and 90 located at the end of the sleeve adjacent base 80 of the handle. Rotation of the sleeve 77 can be effected by use of a tool such as 91 shown in FIG. 6 designed for engagement with slots 89 and 90. Another means for causing rotation of sleeve 77 is shown in FIG. 9. The sleeve 77 has an enlarged diameter portion 101 and an adjustment key 102 carried thereon by pins 103. The base body member 79 is provided with recess 104 in which the key 102 may be stored when not in use. The bolt 26 may also be provided with key 98.

Upon rotation of the sleeve 77, threaded ring 88 will be caused to be axially moved along sleeve 77 by engagement with threads 81 thereby causing the flex elements to be either pulled together or spread apart depending upon the direction of rotation of the sleeve (i.e. rings 87 and 88 moved away from or toward each other). Upon spreading of the flex elements 83 and 84 (i.e. rings 87 and 88 moving toward each other) wall plate 76 will be caused to expand thus enlarging the overall diameter of the grip.

FIG. 6 shows the bottom of the handle 10 of FIG. 5 in which a separate tool is used for adjustment instead of the keys shown in FIG. 9. The slotted head 29 of bolt 26 is accessible through bore 78 of base body member 79. Slots 89 and 90 are likewise accessible through bore 78. Tool 91 may be accommodated within an aperture 92 and secured to the base by a flexible lanyard 93. The aperture 92 may be closed by cover 94 pivotably connected to the base 80 at 95. A name plate identification tag 96 may also be accommodated on the base 80.

The grip of the handle 10 of FIG. 5 may be provided with the rubber covering 21 as in FIGS. 1 and 2 as well as with the cover 22.

FIG. 10 shows another embodiment of a game racket handle with means for expanding the grip. The handle 110 is comprised of a frame formed by end pieces 111 and 112 supported in spaced relationship by struts 113 and 114. End pieces 111 and 112 may have the typical octagonal perimeter and end piece 111 may further be tapered to form the base of the handle 111'. Struts 113 and 114 have an I-beam construction with slots 115 formed in the web portion of the I-beam.

Movable wall plates 116 and 118 form the front and back wall sections of the handle when supported in place between end pieces 111 and 112 on the end surfaces of I-beam struts 113 and 114. The inside surface of wall plates 116 and 118 are profiled so as to form cam surfaces. The inside surface of wall plate 116 is profiled so as to have its cam surfaces 117 inclined at an angle $\alpha$ in a first direction with respect to the longitudinal axis of the handle. The inside surface of wall plate 118 is profiled so as to have its cam surfaces 119 also inclined at an angle $\alpha$ with respect to the longitudinal axis of the handle, but in a direction opposite to that of the incline of surfaces 117. Thus, the total angle between opposing cam surfaces 117 and 119 is $2\alpha$. Wall plates 120 and 122 form the side wall sections of handle 110 when these are supported in place between end pieces 111 and 112 in a position opposite the web portion of the I-beam struts 113 and 114 as illustrated in the exploded view. Side wall plates 120 and 122 have profiled inside surfaces with cam follower elements 121 and 123 respectively. The cam follower elements 121 and 123 are identical in shape and configuration also having inclined surfaces to the longitudinal axis of the handle at an angle $\alpha$ but in opposite directions as seen in FIGS. 12 and 13. The cam follower elements of side wall plates 120 and 122 are arranged so as to fit through the slots 115 of the I-beam struts 113 and 114 respectively when in assembled position so as to extend into the interior portion of the handle between the web portions of the struts.

The outer surfaces 116' and 118' are flat and unprofiled and extend in parallel planes. Similarly outside surfaces 120' and 122' of walls 120 and 122 respectively, are flat and unprofiled and extend in planes parallel to each other. Each of the wall plates have chamfered edges 124 through 127 respectively so as to form a smooth transition with the octagonal periphery of end pieces 111 and 112 when they are fully assembled with the frame of the handle. The ends 128, 129, 130, 131 of the wall plates 116, 118, 120, 122 respectively abut inside surfaces 111'' and 112'' so as to prevent axial displacement of the wall plates when assembled. An outer covering such as the rubber grip element 21 may be wrapped about the wall plates when fully assembled so as to form the grip material and to keep the wall plates properly positioned.

A threaded bolt 133 is journalled for rotation by end pieces 111 and 112. A counter-sunk recess 132 is aligned with a bore through end piece 111 and receives a slotted end 134 of the bolt 133.

An expander assembly 136 has a central internally threaded bore 135 and is carried on threaded bolt 133. The expander assembly 136 is shown in greater detail in FIG. 11. The assembly acts as a cam member and is formed of a plurality of body sections 137, 138 and 139 with beveled ends 137', 138' and 139' respectively. The present embodiment shows three such body sections — however more or less may be used depending upon the rate of adjustment desired. Each body section has a truncated pyramidal shape with four cam surfaces 140, 141, 142 and 143 each of which are inclined at an angle $\alpha$ with respect to the longitudinal axis of the handle. Corresponding cam surfaces of the various body sections lie in parallel planes. When the wall plates 116, 118, 120, 122 are fully assembled, inclined cam surfaces 117 of wall plate 116 will engage with cam surface 141 of each of the body sections of the expander assembly, inclined cam surfaces 119 will engage cam surface 140 of each of the body sections of the assembly, the cam surface of cam elements 121 of wall plate 120 will engage cam surface 142 of each of the body sections, and the cam surface of cam elements 123 on wall plate 122 will engage the cam surface 143 of each of the body sections of the expander assembly. Each of the cam surfaces of the various wall plates, and of each of the engaging cam surfaces of the body sections are inclined at the same angle but in opposing relative directions so as to form mating sections.

When the wall plates are in their fully assembled position and engaging the various cam surfaces of the expander assembly, with the flexible rubber outer covering wrapped about the wall plates, the expander assembly 136 will be constrained from rotational movement about the threaded bolt 133. In operating the expander mechanism shown in FIG. 10 to achieve expansion of the grip, bolt 133 will be rotated in a clockwise direction by an appropriate tool applied to the slotted end 134. Upon such rotation the expander assembly 136 will be caused to move in an axial direction along bolt 133 in a direction to the lower left of the drawing. The cam surfaces 140-143 of each of the body sections being engaged with the cam surfaces of the wall plates will cause each of the wall plates to be moved radially outward from the center of the handle since each wall plate will be constrained from axial movement by end pieces 111 and 112. The greater the number of turns of bolt 133, the treater will be the axial movement of expander 136 so that cam surfaces 117, 119, 121, 123 will slide along the corresponding cooperating cam surfaces of the expander element so as to move the wall plates further outward in a radial direction from bolt 133. The flexible outer covering such as covering 21 wrapped about the wall plates will permit radial movement so that the grip of the handle is expanded to any desired amount.

Rotational movement of bolt 133 in an opposite direction will result in axial movement of cam member 136 in a direction toward the upper right in FIG. 10 so that the cooperating cam surfaces between body sections 137-139 and the profiled cam surfaces of the wall plates will slide along each other in an opposite direction. The outer covering wrapped about the plates will maintain the cam surfaces in contact with each other so that wall plates 116, 118, 120, 122 will be caused to move in radial direction toward the center of the handle effectively decreasing the grip diameter. In this manner a very effective diameter adjusting mechanism for the grip of the handle is achieved.

Bolt 133 may extend through end piece 112 so as to be used for connection to a detachable head of a game racket such as described with reference to FIG. 1.

The angle of incline $\alpha$ of cam surfaces 117 and 119 and of the cam surfaces of cam elements 121 and 123 are identical so that each will move in a radial direction at the same rate and by the same amount. Similarly the angle of incline $\beta$ of each of the cam surfaces 140, 141, 142, 143 of each of the body sections 137, 138, 139 of the expander assembly 136 are also identical to each other and to the angle $\alpha$ so that expansion of each wall plate will be uniform. It has been found in practice that a cam member having three body sections with the angle of incline $\beta$ of the cam surfaces being 10° and the angle $\alpha$ being similarly 10° has proved to be a most acceptable arrangement. Different angles of incline will produce different rates of diameter adjustment. Similarly the thread pitch of bolt 133 will also affect the rate of expansion of the wall plates per turn of the bolt.

The profiled cam surfaces of each of the wall plates may be formed by an appropriate machining operation or more preferably by molding. The wall plates 116, 118, 120, 122 are preferably formed of molded plastic material so that the inclined surfaces may be easily molded to the desired angle.

Cam member 136 may also be machined however it is also found desirable that this be formed by a similar molding operation.

It should be apparent from the foregoing that a useful and novel hybrid tennis racket is provided by the present invention in which a head portion may be securely connected to a detachable handle portion permitting the use of a head formed of one material with an handle formed of a different material and which may further include a means for varying the size of the grip.

While the invention has been described and illustrated with respect to certain embodiments which give satisfactory results, it will be understood by those skilled in the art, after understanding the purpose of the invention that various other changes and modifications may be made without departing from the spirit and scope of the invention, and it is therefore intended in the appended claims to cover all such changes and modifications.

What we claim is:

1. A game racket comprising a head, having a surface for contacting a playing ball and a partially hollow handle connected to said head, said handle being formed of a frame having two end pieces and struts extending therebetween defining a grip portion, and a flexible grip surrounding said handle, a rotatable member having a threaded external surface and carried by said handle axially therethrough, radially movable wall plates forming the external structure of said partially hollow portion of said handle and supported by said frame, a cam member carried on said rotatable member within said handle and comprising a plurality of body sections each of which has more than one cam surface inclined at an angle to the longitudinal axis of said handle, each body section being of identical configuration and orientation so that corresponding cam surfaces of each body section lie in parallel planes, each of said cam surfaces being in contact with cooperating surfaces on said wall plates, and means for rotating said rotatable member so that said cam member will apply pressure to said wall plates for varying the diameter of said grip.

2. The game racket according to claim 1 wherein said means for rotating said rotatable member comprises at least one slot at one end thereof, and a tool for engagement with said slot.

3. The game racket according to claim 2 wherein said means for rotating said rotatable member comprises a key pivotally carried at one end of said rotatable member.

4. The game racket according to claim 1 wherein said cam member is internally threaded so as to be axially movable upon rotation of said rotatable member, so that upon rotation of said rotatable member in one direction said cam member will exert a force on said wall plates causing radial movement thereof and variation in the diameter of said handle in one direction, and upon rotation of said rotatable member in the other direction, said wall plates will be caused to move in the opposite radial direction.

5. A game racket comprising a head and a partially hollow handle connected to said head, said handle having a grip portion, a rotatable member carried by said handle axially therethrough, radially movable wall plates supporting the external structure of said partially hollow portion of said handle, means carried on said rotatable member within said handle engaging said wall plates for varying the outside diameter of said grip portion, and a flexible grip covering the exterior of said handle, said rotatable member being a rod having an external surface at least partially threaded, said rod centrally located within said handle and axially extending therethrough, said outside diameter varying means comprising a cam member carried on said threaded rod and movable upon rotation of said rod, said cam member having cam surfaces bearing against said radially movable wall plates, means for rotating said rod so that upon rotation thereof in one direction said cam member will exert a force on said wall plates causing radial movement thereof and variation in the diameter of said handle in one direction, and upon rotation of said rod in the other direction, said wall plates will be caused to move in the opposite radial direction, said handle comprising a frame having two end pieces and at least two struts connecting said end pieces, each of said wall plates being supported by said frame and having a profiled inside surface so as to form cam surfaces inclined at an angle to the longitudinal axis of said handle, the angle of inclination of each of said cam surfaces of said wall plates being of equal value, the direction of the angle of inclination of cam surfaces on oppositely facing wall plates being oppositely directed, said wall plates fitting between said end pieces so as to be constrained from axial displacement, said cam member comprising at least one body section having a truncated pyramidal shape with cam surfaces formed on the faces thereof for cooperative engagement with the cam surfaces of said wall plates, each body section having an axis coincident with the longitudinal axis of said handle, said body section cam surfaces being inclined at an angle to the longitudinal axis of said handle, the angle of inclination of each body section cam surface being identical and oppositely directed to the angle of incline of the corresponding wall plate cam surface cooperating therewith, an internally threaded axial bore extending through the altitude of said body section, said rod extending through said bore so that upon rotation of said rod said cam member will be axially displaced along said rod and cause said wall plates to be radially moved by cooperation between said cam surfaces thereby adjusting the outside diameter of said handle.

6. The game racket according to claim 5 wherein said angle of incline of said wall plate cam surfaces and of said cam member cam surfaces is approximately 10°.

7. A game racket comprising a head and a partially hollow handle connected to said head, said handle having a grip portion, and formed by a strut structure carried between two end pieces, a rotatable member carried by said handle axially therethrough, radially movable wall plates carried by said strut structure for supporting the external structure of said partially hollow portion of said handle, means carried on said rotatable member within said handle engaging said wall plates for varying the outside diameter of said grip portion, and a flexible grip covering the exterior of said handle, said rotatable member being a rod having an external surface at least partially threaded, said rod centrally located within said handle axially extending therethrough and rotatably journaled in said end pieces, said outside diameter varying means comprising an expander assembly carried on the threaded portion of said rod and in contact with said wall plates, and means for rotating said rod so that said expander assembly will apply pressure to said wall plates varying the diameter of said grip, said expander assembly comprising a cam member formed by a plurality of body sections each having a substantially truncated pyramidal shape and each having its altitude coincident with the longitudinal axis of said handle, the base portion of each body section facing in the same direction so that corresponding sides of said sections lie in parallel planes and form cam surfaces inclined at the same angle to the axis of said rod, said wall plates having mating cam surfaces inclined at an angle to the longitudinal axis of said handle, the angle of inclination of said cam surfaces on said cam member being equal and oppositely directed to the angle of inclination of the cam surfaces on said wall plate, the angle of incline of cam surfaces on opposing wall plates being equal and oppositely directed, said end pieces carried by said supporting structure preventing axial displacement of said wall plates, said cam surface of said cam member cooperating with the cam surface of said wall plates so that upon axial movement of said cam member said wall plates will be radially moved so as to vary the outside diameter of said handle, and axial movement of said cam member being effected by rotation of said rod.

* * * * *

UNITED STATES PATENT OFFICE

CERTIFICATE OF CORRECTION

PATENT NO. : 3,968,965

DATED : July 13, 1976

INVENTOR(S) : Richard E. Frenkel et al

It is certified that error appears in the above-identified patent and that said Letters Patent are hereby corrected as shown below:

Column 11, line 21, before "each of said" insert --said rod being rotatably journalled between said end pieces,--

Signed and Sealed this

Twelfth Day of October 1976

[SEAL]

*Attest:*

RUTH C. MASON
*Attesting Officer*

C. MARSHALL DANN
*Commissioner of Patents and Trademarks*